US005269107A

United States Patent [19]

Klemm

[11] Patent Number: 5,269,107

[45] Date of Patent: Dec. 14, 1993

[54] MOBILE BORING RIG

[75] Inventor: Guenter W. Klemm, Olpe, Fed. Rep. of Germany

[73] Assignee: Ing. Guenter Klemm Bohrtechnik GmbH, Fed. Rep. of Germany

[21] Appl. No.: 921,141

[22] Filed: Jul. 29, 1992

[30] Foreign Application Priority Data

Aug. 24, 1991 [DE] Fed. Rep. of Germany ..... 9110495

[51] Int. Cl.[5] ..... D04H 12/34

[52] U.S. Cl. ..... 52/115; 52/116

[58] Field of Search ..... 52/111, 114, 115, 116, 52/117, 119, 123.1; 212/182, 183, 185

[56] References Cited

U.S. PATENT DOCUMENTS 2,683,584 7/1954 Selberg ..... 52/116 X
2,955,431 10/1960 Taylor, Jr. ..... 52/114
3,109,523 11/1963 Moller ..... 52/111 X
3,205,627 9/1965 Gyongyosi ..... 52/115
3,220,585 11/1965 McCartney et al. ..... 254/8 C
3,805,463 4/1974 Lang et al. ..... 52/116
4,269,395 5/1981 Newman et al. ..... 52/115 X
4,368,602 1/1983 Manten ..... 52/115

*Primary Examiner*—Carl D. Friedman
*Assistant Examiner*—Kien Nguyen
*Attorney, Agent, or Firm*—Diller, Ramik, & Wight

[57] ABSTRACT

Mounted on a vehicle (10), the mast (20) of a boring rig is supported by an erection hinge (18). The erection hinge (18) is provided on a first carriage (19) having a support cylinder attached (28) to it for the purpose of support and erection of the mast (20). The hydraulic erection cylinder (24), attached to the vehicle (10), is connected to the second carriage (21). The mast (20) is extended to an oblique angle by the hydraulic erection cylinder (24). The final phase of the erection of the mast (20) is completed by the retraction of the secondary take-in cylinder (27), which connects the two carriages together. When in a horizontal position, the mast (20) can be guided in a longitudinal direction in order to have a more favorable position of the center of gravity on the vehicle (10).

5 Claims, 3 Drawing Sheets

MOBILE BORING RIG

The invention is directed to a mobile boring rig having a horizontally declinable mast which is attached to the vehicle.

The mast length of a mobile boring rig having a declinable mast is normally limited since the vehicle with a horizontally declinable mast supports excess weight causing one end of the vehicle to rise up from the ground. A further problem lies in the fact that, the hydraulic erection cylinder, which erects the mast, can only have a limited distance from the erection hinge and therefore it is not suitable to move a large mast over the entire angle of traverse. Generally, when erecting a long mast, numerous cylinders are required as well as several hinges within the erection mechanism. However, an extensive hinge structure leads to considerable instability of the mast since every hinge has a certain amount of clearance and the hinge clearance adds up.

It is the object of the invention to provide a mobile boring rig which offers a simple erection device for the mast and permits the use of a long mast. According to the invention, the mast of the boring rig is guided by two carriages which are placed on the mast with mutual distance. One carriage is attached to the erection hinge, while the other is controlled by the hydraulic erection cylinder. One of the carriages is connected to the mast visa support cylinder. The support cylinder makes it possible to move the mast in relation to the carriage. Thereby, it is possible to shift the mast, when the mast is in a horizontal position in relation to the vehicle, so that part of the mast can jut out to the front and back of the vehicle and the center of gravity can be shifted on the vehicle. A further advantage is that the mast can be moved vertically in a vertically raised position, in order, for instance, to be set on the ground or to hold it in space above the ground.

It is further advantageous that the components holding the mast in the raised position require only a few hinges. These components are mainly the two hinges at the end of the hydraulic erection cylinder, in which the clearance can impair the stability of the raised mast.

In accordance to an advantageous embodiment of the invention, the first and second carriage are joined together by a secondary take-in cylinder. This secondary take-in cylinder regulates the distance of the two carriages and allows the use of a relatively short hydraulic erection cylinder. The hydraulic erection cylinder only needs to raise the mast to a certain extent. When the cylinder is fully extended but the mast is still in an oblique angle, the secondary take-in cylinder is retracted whereby the second carriage is glided down the mast and correspondingly the mast is raised into a vertical position. The phase in which the erection of the mast requires a large amount of force, the second carriage is farthest away from the first so that the force of the hydraulic cylinder generates a large erection momentum. In the last phase of the erection of the mast, the required erection momentum is reduced. The hydraulic erection cylinder is already completely extended and the complete erection of the mast is achieved when the secondary take-in cylinder draws the second carriage to the first. Consequently, the length of the hydraulic erection cylinder can be made as small as required, if the cylinder is secured to the mast.

A preferred embodiment of the invention will be described in greater detail with reference to the accompanying drawings and a corresponding description of their parts:

Figure 1:
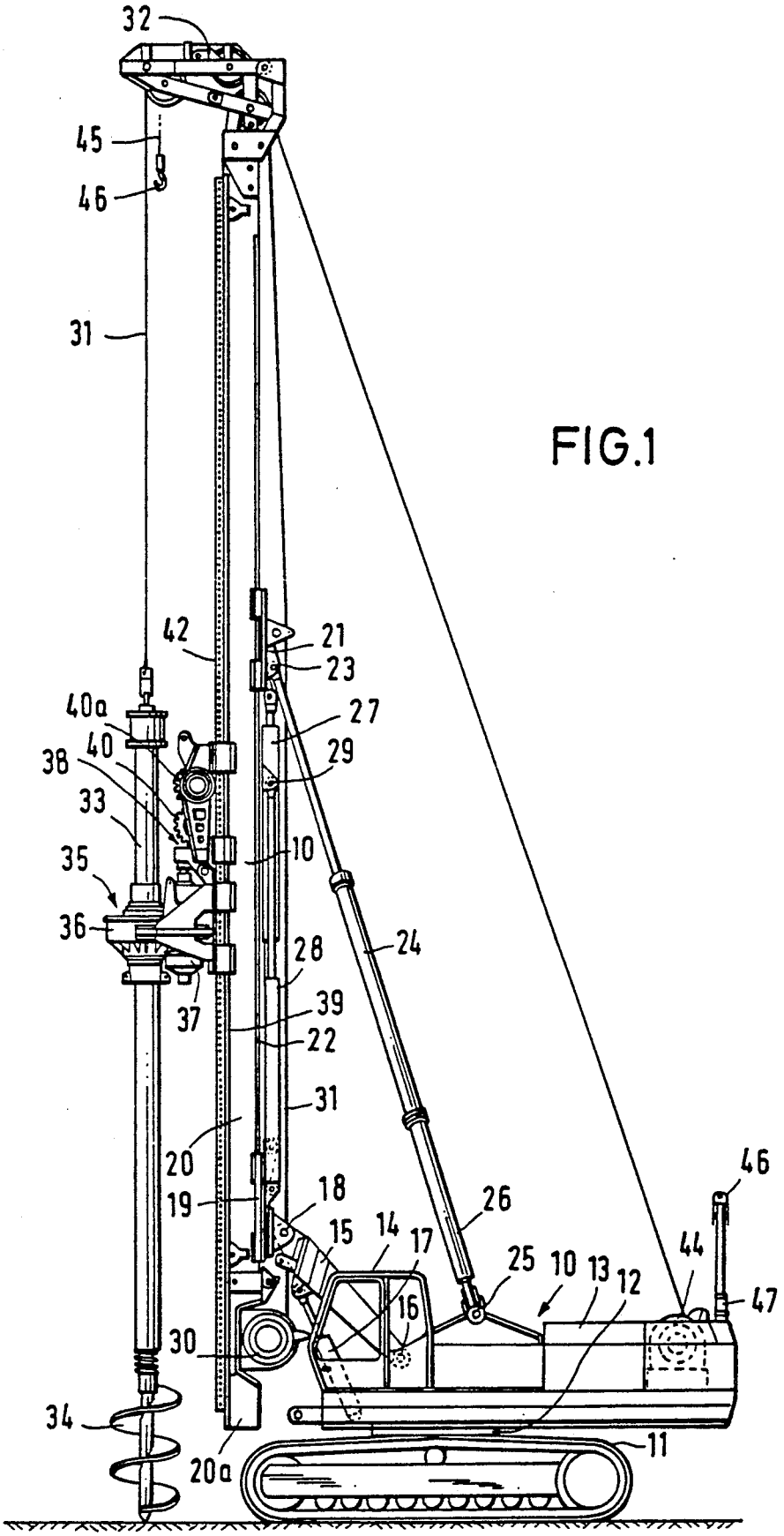
FIG. 1 is a side view of the mobile boring rig with erected mast.
Figure 2:
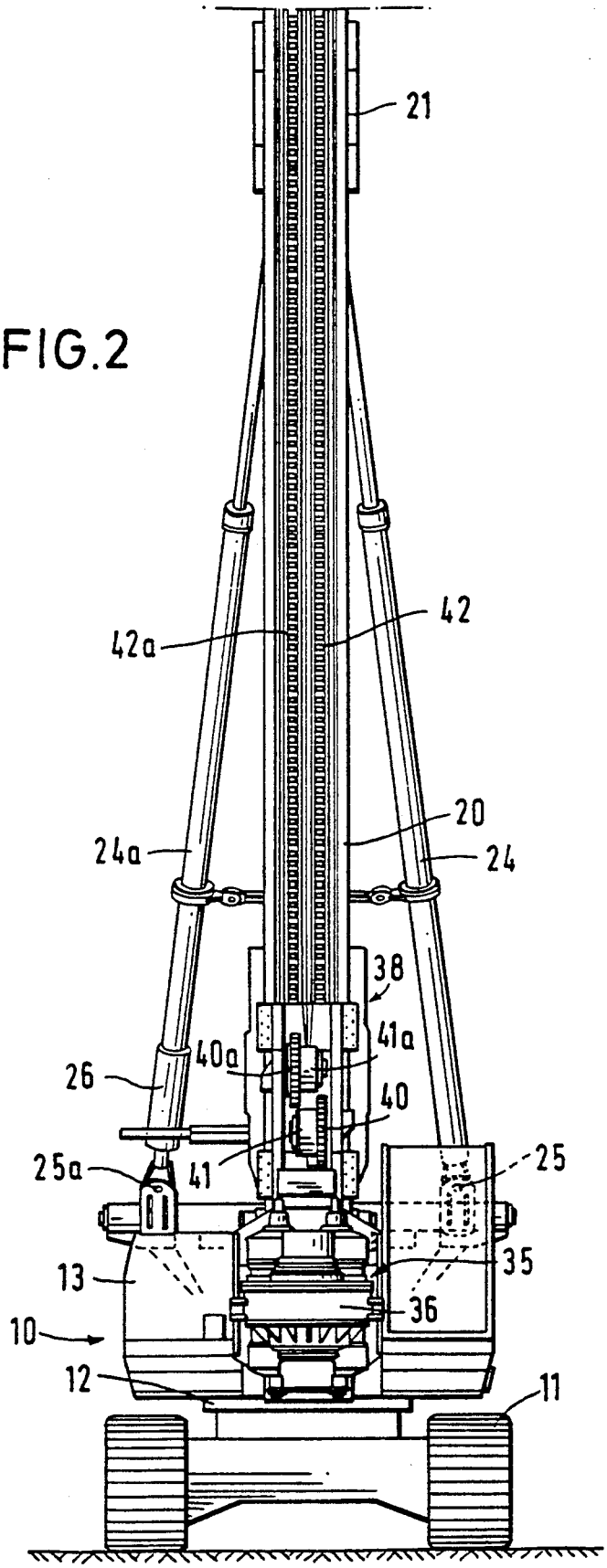
FIG. 2 is a front view of FIG. 1.

The illustrated mobile boring rig shows a vehicle 10 that is designed as a chain vehicle having tracks 11. Above tracks 11 and on top of a rotating circular plate 12 the superstructure 13 is mounted. On the side of vehicle 10 next to the driver's cabin 14, a forward facing cantilever 15 is attached to a horizontally pivoting hinge 16. Cantilever 15 is pivoted by a hydraulic cylinder 17 having one end attached to cantilever 15 and the other to vehicle 10. The front end of cantilever 15 is secured to an erection hinge 18 on the first carriage 19, in which the mast is guided for a longitudinal movement. Furthermore, for moving the mast, a second carriage 21 is used, which engages with the same track 22 of the mast 20 as the first carriage 19. Two hydraulic erection cylinders 24, **24*a* are attached to the second carriage 21 by a hinge 23 and they are secured to superstructure 13 of the vehicle by two hinges 25, 25*a*. These hinges are approximately (longitudinal) in the middle of superstructure 13, i.e., near the cross center plane of tracks 11, when superstructure 13 is aligned in the direction of the tracks. As FIG. 2 shows, hinges 25, 25*a* are arranged directly opposite one another on the sides of superstructure 13, so that the hydraulic erection cylinder 24, as seen from the frontal view, extends from the sides upwards and inwards, thereby creating with superstructure 13 an isosceles triangle having the second carriage 21 as the top of the triangle. The two hydraulic erection cylinders 24, 24*a* are synchronously pressurized. One of the hydraulic erection cylinders 24*a* is equipped with alteration means in the form of a length adjusting device 26, also in the form of a hydraulic cylinder, which is separately controlled. This device allows the additional length of this hydraulic erection cylinder 24*a* to be changed in order to turn mast 20 in a limited range of angles and/or tilt the mast 20 sideways relative to the vehicle. Thereby, the unevenness of the ground on which vehicle 10 rests can be compensated in relation to superstructure 13** in a sideways direction.

Both carriages 19 and 21 are connected together by a secondary take-in cylinder 27, which is directly adjacent to and parallel to mast 20. Furthermore, the secondary take-in cylinder 27 can be adapted to change the distance between the two carriages 19 and 21.

Parallel to mast 20 is another hydraulic cylinder, the support cylinder 28, whereof one end is attached to the first carriage 19 and the other end to a hinge 29, connected to mast 20. Support cylinder 28 extends lengthwise along side the secondary take-in cylinder 27 and it regulates the longitudinal movement of the mast in relation to the two carriages 19 and 21.

Located at the lower end of mast 20 underneath the first carriage 19 is a cable wrench 30 having a cable 31 extending along the mast length to a trolley head 32 located at the top of the mast 20. Attached to the hanging end of cable 31 is a boring rod 33, i.e. , a telescopic rod. At the other end of the rod, a gimlet bit 34 is attached, which will be driven into the ground spinning in order to produce a bore hole. The boring rod 33 extends through a rotating motor 35. The rotating motor 35 consists of two parts: a turning mechanism 36, which surrounds boring rod 33 and which also includes a rotating circular track, and at least one hydraulic motor 37 for driving the rotating track. Rotating motor 35 is mounted on a displacement carriage 38, which is guided on another track 39 on the mast 20.

The displacement carriage 38 is equipped with a driving device for driving it along track 39. This driving device exhibits two sprockets 40, 40*a* propelled by motor 41 and 41*a* respectively on separate gear tracks 42 and 42*a* respectively. Each gear track 42, 42*a* consists of a bolted drive chain, which is stretched along and runs parallel to mast 20. Each bolted drive chain has two skirt boards having bolts connecting them, forming as it were the rungs to a ladder. The sprockets cooperate with these crossbolts so that the space between the sprocket teeth grip the bolts. Thereby, displacement carriage 38 has its own driving device in order to propel it along mast 20. Attached to the rear of superstructure 13 of vehicle 10 is a further cable wrench 44 from which a cable 45 is extended to trolley head 32. A crane hook 46 is attached to the hanging end of this cable 45.

Figure 3:
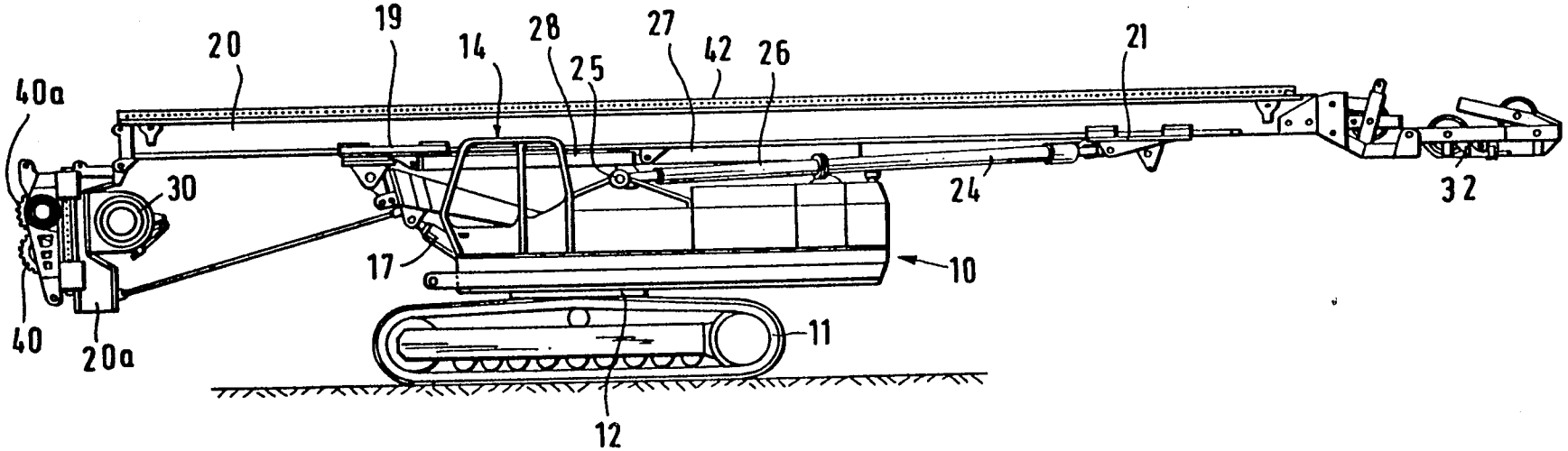
FIG. 3 is a side view of the boring rig with horizontally positioned mast.

In FIG. 3, where mast 20 is depicted in a horizontal position, vehicle 10 is ready to be driven and to transport. Herein, mast 20 can be shifted by the support cylinder 28 in its longitudinal direction, so that the front end of the mast can be moved in the driving direction, and even with a long mast, the center of gravity of the mast can be maneuvered towards the middle (in a longitudinal direction) of the vehicle. Cantilever 15 is located in its lowered position, i.e., in an almost horizontal position, and the two inclining hydraulic cylinders 24, 24*a* extend from hinges 25, 25*a* towards the rear of vehicle 10. Thus, the first carriage 19 is situated in front of the hinges 25, 25*a* and the second carriage is situated behind these hinges. A mast support 46 is located at the rear end of superstructure 13—moveable by a support cylinder 47 in a vertical direction—, which in its lowered position supports the horizontally positioned mast 20.

When erecting mast 20 from its horizontal position, as illustrated in FIG. 3, mast 20 is first maneuvered into its rearward end position by support cylinder 28, without changing the positions of carriages 19 and 21. Then, with the use of support cylinder 47, mast support 46 is raised in order to increase the angle between mast 20 and the hydraulic erection cylinders 24 and 24*a*. Under the just mentioned procedure, the secondary take-in cylinder 27 is in its extended position, i.e. carriages 19 and 21 have their largest possible distance span between one another.

The length of the hydraulic erection cylinders 24, 24*a* is not sufficient to erect mast 20, with fully extended secondary take-in cylinder 27, to the perpendicular position. When the hydraulic erection cylinders 24, 25*a* are completely extended, mast 20 will have a 60 degree angle to the horizontal. The last phase of the erection of mast 20 will be executed by the retraction of the secondary take-in cylinder 27. As a result, the second carriage 21 will be drawn towards the first carriage 19, whereby mast 20 is raised. The length of the secondary take-in cylinder 27 is measured in such a manner that mast 20 can still be pivoted in a small angle of approximately 4 degrees from the vertical position in order to compensate for possible unevenness of the ground (in longitudinal direction). The secondary take-in cylinder 27 can also carry out compensation for such an angle in the opposite direction.

Through the activation of hydraulic cylinder 17, cantilever 15 can be raised in order to raise carriages 19 and 21 and, thereby, raising the entire mast 20. With the erection of the mast, the lower end of the mast 20*a* is located in the space between the chains of tracks 11 so that it cannot strike against the chains of the vehicle. Through the activation of hydraulic cylinder 17, the lower end of the mast 20*a* is raised above the tracks of the vehicle so that superstructure 13 along with mast 20 can be rotated without the tracks of the vehicle hindering this motion. The raising of the first carriage 19 in relation to vehicle 10 has a further advantage, in that cable wrench 30, located under the first carriage 19 when mast 20 is raised, can have a much larger distance to the ground in order to prevent soiling from dirt or mud.

Instead of pivoting cantilever 15 through the use of hydraulic cylinder 17, it is possible to move the first carriage 19 in a vertical direction by means of a vertically elevating mechanism without using a horizontal component.

The returning of mast 20 to a horizontal position begins first with the retraction of hydraulic cylinder 17, which lowers mast 20. Then the secondary take-in cylinder 27 is extended, whereby the mast is tilted to a 60 degree angle. The subsequent lowering of mast 20 occurs with the retraction of the hydraulic erection cylinders 24, 24*a* until they have reached the upward extended mast support 46. The last phase of the lowering of mast 20 is achieved by the retraction of support cylinder 47. Thereafter, support cylinder 47 is retracted in order to bring the mast to a suitable horizontal position on top of vehicle 10 so that it is ready to be transported.

Instead of having the secondary take-in cylinder 27—responsible for adapting the distance between the carriages 19 and 21—it is possible to interconnect the two carriages at a fixed distance. In this case, though, the inclining hydraulic cylinders 24, 24*a* must be so long that they are able to raise mast 20 to the vertical position.

I claim:

1. Mobile boring rig comprising a vehicle (10), a mast (20) which is mounted on the vehicle (10) and is able to pivot about an erection hinge (18) to a lying and raised position, and at least one hydraulic erection cylinder supported on the vehicle, characterized in that the erection hinge (18) is provided on a first carriage (19), along which the mast (20) is guided, and an inclining hydraulic cylinder (24) is attached to a second carriage (21), whereby the mast (20) is pivotally guided, one of the carriages (19, 21) is connected with the mast (20) by a support cylinder (28) for displacement of the mast along both carriages, and the first carriage (19) and the second carriage (21) being connected by a secondary take-in cylinder (27).

2. Boring rig according to claim 1, wherein, the erection hinge (18) is adjustable to various heights by an elevating mechanism (15, 17) of the vehicle (10).

3. Boring rig according to claim 2, wherein, the elevating mechanism consists of a cantilever (15) attached to the vehicle (10) and a cantilever cylinder (17) for pivoting the cantilever (15).

4. Boring rig according to claim 1, wherein, the vehicle (10) comprises a vertically acting support cylinder (47), spaced from the erection hinge, containing on top of it a mast support (46), which together with support cylinder (47) erects the mast (20) to a sloping position before the further erection of the mast (20) is taken over by the hydraulic erection cylinder (24).

5. Boring rig according to claim 1, wherein, two hydraulic erection cylinders (24, 24*a*) , supported on opposite sides of the vehicle (10), are provided, and where at least one of them provides an additional alteration means for sideways tilting of the mast (20) relative to the vehicle (10).

* * * * *